US009639030B2

(12) United States Patent
Komatsu

(10) Patent No.: US 9,639,030 B2
(45) Date of Patent: May 2, 2017

(54) IMAGE FORMING APPARATUS FOR APPLYING A LUBRICANT TO AN IMAGE-BEARING MEMBER

(71) Applicant: CANON KABUSHIKI KAISHA, Tokyo (JP)

(72) Inventor: Isao Komatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/734,986

(22) Filed: Jun. 9, 2015

(65) Prior Publication Data

US 2015/0362884 A1 Dec. 17, 2015

(30) Foreign Application Priority Data

Jun. 12, 2014 (JP) ..... 2014-121100

(51) Int. Cl.
*G03G 15/16* (2006.01)
*G03G 21/00* (2006.01)

(52) U.S. Cl.
CPC ..... *G03G 15/161* (2013.01); *G03G 21/007* (2013.01); *G03G 2215/0129* (2013.01)

(58) Field of Classification Search
CPC ..... G03G 21/007–21/0082
USPC ..... 399/346
See application file for complete search history.

(56) References Cited

U.S. PATENT DOCUMENTS

| | | | | |
|---|---|---|---|---|
| 7,680,446 | B2 * | 3/2010 | Shintani | G03G 21/0035 399/167 |
| 8,380,115 | B2 * | 2/2013 | Shintani | G03G 21/0011 399/346 |
| 8,396,408 | B2 * | 3/2013 | Amemiya | G03G 21/0011 399/346 |
| 2013/0011145 | A1 * | 1/2013 | Nishimura | G03G 15/553 399/12 |
| 2015/0268618 | A1 * | 9/2015 | Itoh | G03G 21/0094 399/346 |

FOREIGN PATENT DOCUMENTS

| | | |
|---|---|---|
| JP | 2004-325923 A | 11/2004 |
| JP | 2004-325924 A | 11/2004 |

(Continued)

*Primary Examiner* — Minh Phan
*Assistant Examiner* — Leon W. Rhodes, Jr.
(74) *Attorney, Agent, or Firm* — Canon U.S.A. Inc., IP Division

(57) ABSTRACT

An image forming apparatus includes an image-bearing member bearing a toner image, a transfer unit transferring the toner image on the image-bearing member to a printing medium, a cleaning member rubbing against the image-bearing member and scraping away transfer residual toner from the image-bearing member, and a lubricant applying unit applying a lubricant to the image-bearing member. The apparatus further includes a driving unit driving the lubricant applying unit and a controller controlling the driving unit such that when a period required for an area corresponding to an interval between printing media to pass through a transfer position is longer than or equal to a predetermined set period during image formation, the amount of lubricant applied by the lubricant applying unit is at least lower than that in a case where the period required is shorter than the predetermined set period.

14 Claims, 8 Drawing Sheets

(56) References Cited

FOREIGN PATENT DOCUMENTS

| | | | | |
|---|---|---|---|---|
| JP | 2006-084649 | A | | 3/2006 |
| JP | 2007-140085 | A | | 6/2007 |
| JP | 2008-116547 | A | | 5/2008 |
| JP | 2009-15229 | A | | 1/2009 |
| JP | 2012083375 | A | * | 4/2012 |
| JP | 5637499 | A | | 12/2014 |

* cited by examiner

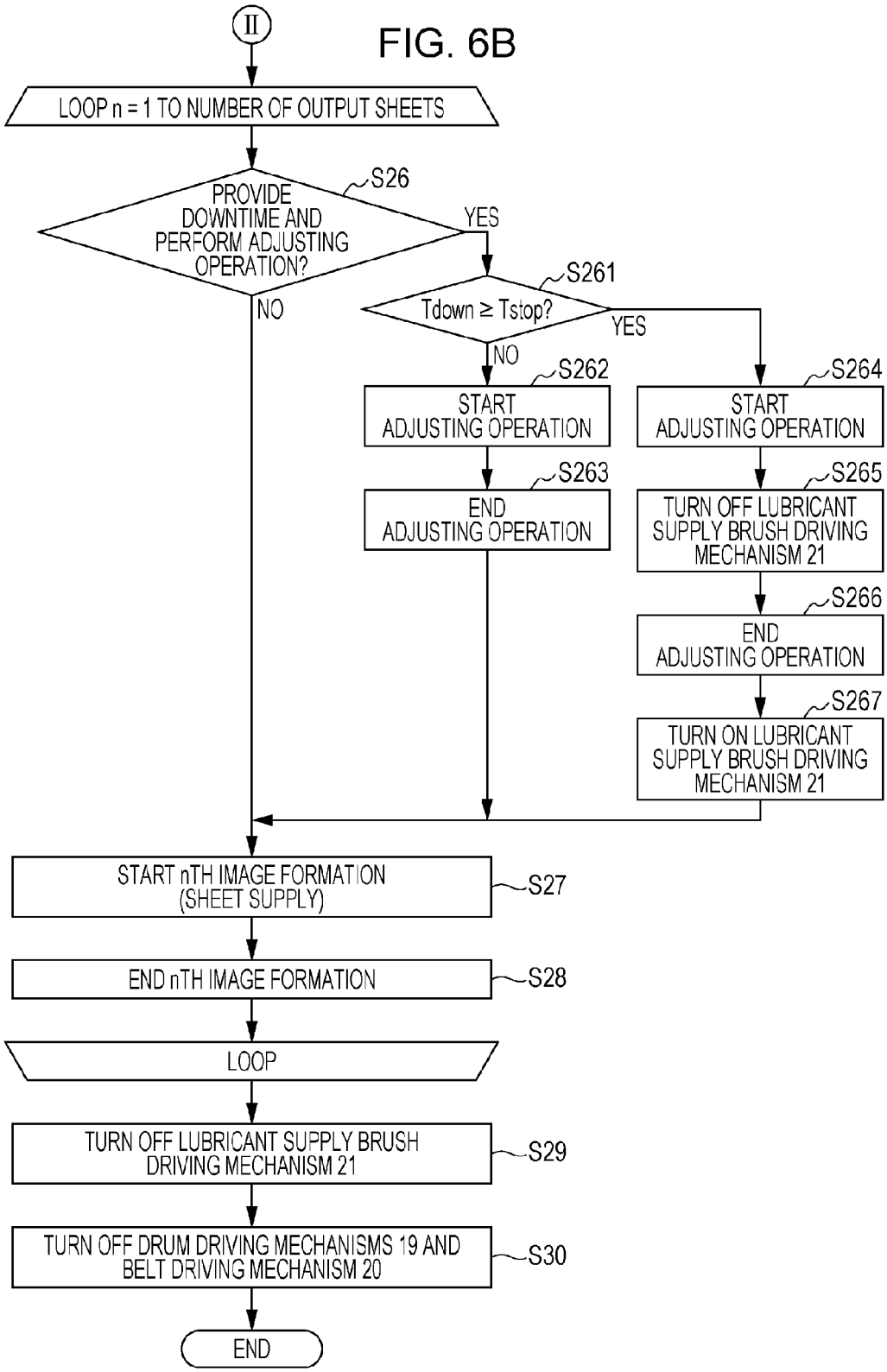
II
FIG. 6B
LOOP n = 1 TO NUMBER OF OUTPUT SHEETS
S26
PROVIDE DOWNTIME AND PERFORM ADJUSTING OPERATION?
YES
NO
S261
Tdown ≥ Tstop?
YES
NO
S262
START ADJUSTING OPERATION
S263
END ADJUSTING OPERATION
S264
START ADJUSTING OPERATION
S265
TURN OFF LUBRICANT SUPPLY BRUSH DRIVING MECHANISM 21
S266
END ADJUSTING OPERATION
S267
TURN ON LUBRICANT SUPPLY BRUSH DRIVING MECHANISM 21
START nTH IMAGE FORMATION (SHEET SUPPLY)
S27
END nTH IMAGE FORMATION
S28
LOOP
TURN OFF LUBRICANT SUPPLY BRUSH DRIVING MECHANISM 21
S29
TURN OFF DRUM DRIVING MECHANISMS 19 AND BELT DRIVING MECHANISM 20
S30
END

IMAGE FORMING APPARATUS FOR APPLYING A LUBRICANT TO AN IMAGE-BEARING MEMBER

BACKGROUND OF THE INVENTION

Field of the Invention

The present invention relates to an image forming apparatus including a mechanism for applying a lubricant to an image-bearing member.

Description of the Related Art

Image forming apparatuses, such as copiers, printers, and fax machines, using photolithography include intermediate transfer tandem system image forming apparatuses each including an intermediate transfer belt to which a toner image on a photosensitive drum is transferred while the belt is rotating in contact with the photosensitive drum. Some of these image forming apparatuses each include a cleaning blade made of an elastic material, such as urethane rubber, as a cleaning unit for cleaning transfer residual toner or the like on an image-bearing member, e.g., the photosensitive drum or the intermediate transfer belt. Some of the image forming apparatuses including the cleaning blade are configured such that smooth sliding between the image-bearing member and the cleaning blade is maintained using a developer, such as toner or an external additive contained in the toner. In such a configuration, a charge amount of the developer tends to vary depending on ambient temperature and humidity. If the amount of developer reaching the cleaning blade markedly decreases, the smooth sliding of the cleaning blade will fail to be maintained. Unfortunately, this may cause a phenomenon (called "blade turn-up") in which the blade reversely turns from its end as a start point.

Image forming apparatuses recently developed to stabilize smooth sliding are configured such that a solid lubricant, as represented by zinc stearate, is supplied (or applied) to the image-bearing member. In such a configuration for lubricant application, a fur brush (rotating brush) of nylon or the like against which the solid lubricant is pressed is in contact with the rotating image-bearing member, thus applying the lubricant to a surface of the image-bearing member with the fur brush which is slightly scraping away the lubricant.

The amount of solid lubricant needed varies because stability at the nip between the cleaning blade and the image-bearing member changes depending on operating conditions or the like of the image forming apparatus. For example, an image forming apparatus including a supply amount adjustment unit for changing the amount of lubricant has recently been developed (refer to Japanese Patent Laid-Open No. 2007-140085). In this image forming apparatus, a lubricant supply device for supplying a lubricant to a surface of any one of a photosensitive drum, an intermediate transfer belt, and a secondary transfer roller, serving as a target member that bears a toner image thereon, adjusts the amount of lubricant supplied by changing the number of rotations of an applying roller or pressure. When a new solid lubricant is attached, or alternatively, when a condition where the area of output images is large (or image density is high) is continued, control is performed such that the amount of lubricant is increased by increasing the number of rotations of the applying roller, for example.

In addition, an image forming apparatus known in the art is configured such that the amount of solid lubricant applied is changed depending on the amount of toner detected by a sensor unit (refer to Japanese Patent Laid-Open No. 2008-116547). In this image forming apparatus, control is performed such that the amount of lubricant applied is increased in response to detection of a large amount of toner by the sensor unit.

Another image forming apparatus known in the art is configured such that the amount of lubricant applied is changed in accordance with stored image forming information (refer to Japanese Patent Laid-Open No. 2009-15229). In this image forming apparatus, control is performed such that the number of rotations of an applying brush is increased at the start of image formation and the number of rotations is reduced over time during image formation. In addition, control is performed such that when image forming information indicates an early stage of image formation, the number of rotations is set to a small value and the number of rotations is increased over time.

Still another image forming apparatus known in the art includes an application amount control mechanism that controls a lubricant applying unit to change the amount of lubricant applied in accordance with the magnitude of rotational torque of a photosensitive drum (refer to Japanese Patent Laid-Open No. 2004-325924). In this image forming apparatus, control is performed such that the amount of lubricant applied is increased when the rotational torque of the photosensitive drum is greater than a reference value.

As regards an image-bearing member to contact a printing medium, such as a sheet of paper, when a lubricant is applied to the image-bearing member, only part of the lubricant applied to the image-bearing member is supplied to a cleaning blade during sheet supply because the lubricant is transferred to the printing medium. In some cases, control for extending a sheet-to-sheet interval (interval between printing media conveyed) during waiting for adjustment of fixing temperature (temperature adjustment) or waiting for conversion of image data is performed in order to maintain productivity. In such a case, substantially the whole of the lubricant supplied to the image-bearing member is supplied to the cleaning blade.

If the lubricant is excessively supplied to the cleaning blade, frictional force acting between the cleaning blade and the image-bearing member will increase too much. Disadvantageously, this may cause vibration (hereinafter, referred to as "blade chattering") of the cleaning blade or blade turn-up. Furthermore, during downtime for sheet-to-sheet interval automatic adjustment (e.g., density adjustment) with no sheet supply, the lubricant on the image-bearing member is not absorbed by a printing medium. Disadvantageously, this may cause excessive supply of the lubricant.

Study results demonstrated that the amount of lubricant taken away from an image-bearing member varies depending on the type of paper supplied. Whereas paper having a smooth surface taken a large amount of lubricant away from the image-bearing member, paper having a rough surface, in particular, recycled paper having a smoothness less than 20 s, taken a small amount of lubricant away from the image-bearing member. The smoothness was measured in conformity with Japanese Industrial Standards (JIS) P 8119:1998.

Furthermore, the amount of lubricant taken away from the image-bearing member also varies depending on the material of paper supplied. An overhead transparency (OHT) sheet takes less lubricant away from the image-bearing member than plain paper. The OHT sheet and recycled paper may cause a large amount of lubricant to be supplied to the cleaning blade. In supplying thick paper or OHT sheets, control for reducing process speed (peripheral velocity) is typically performed in order to increase fixability. A constant ratio of linear velocity of an applying member to process speed results in a substantially constant amount of lubricant applied to the image-bearing member. Accordingly, if process speed of the image-bearing member is reduced, rotation speed of the applying member can also be reduced.

Under the above-described circumstances, Japanese Patent Laid-Open Nos. 2007-140085, 2008-116547, 2009-15229, and 2004-325924 describe that the amount of lubricant applied is adjusted depending on a certain condition, but do not take account of excessive supply of a lubricant to a cleaning blade caused during, for example, downtime, supply of different printing media, or an image-bearing member idle rotation mode.

SUMMARY OF THE INVENTION

The present invention provides an image forming apparatus that prevents excessive supply of a lubricant to a cleaning member to stabilize frictional force and avoid blade chattering, blade turn-up, or the like.

An aspect of the present invention provides an image forming apparatus including a rotatable image-bearing member configured to bear a toner image, a transfer unit configured to transfer the toner image on the image-bearing member to a printing medium passing through a transfer position, a cleaning member disposed downstream of the transfer unit in a rotating direction of the image-bearing member and configured to rub against the image-bearing member and scrape away transfer residual toner from the image-bearing member, a lubricant applying unit disposed between the transfer unit and the cleaning member and configured to apply a lubricant to the image-bearing member, a driving unit configured to drive the lubricant applying unit in order to apply the lubricant to the image-bearing member, and a controller configured to control the driving unit in such a manner that when a period required for an area corresponding to an interval between printing media to pass through the transfer position is longer than or equal to a predetermined set period during image formation, during which the toner image is formed, an amount of the lubricant applied by the lubricant applying unit is at least lower than that in a case where the period required for the area to pass through the transfer position is shorter than the predetermined set period.

Further features of the present invention will become apparent from the following description of exemplary embodiments with reference to the attached drawings.

BRIEF DESCRIPTION OF THE DRAWINGS

FIGS. 6A and 6B illustrate a flowchart of a process for image formation in a second embodiment of the present invention.

DESCRIPTION OF THE EMBODIMENTS

First Embodiment

Figure 1:
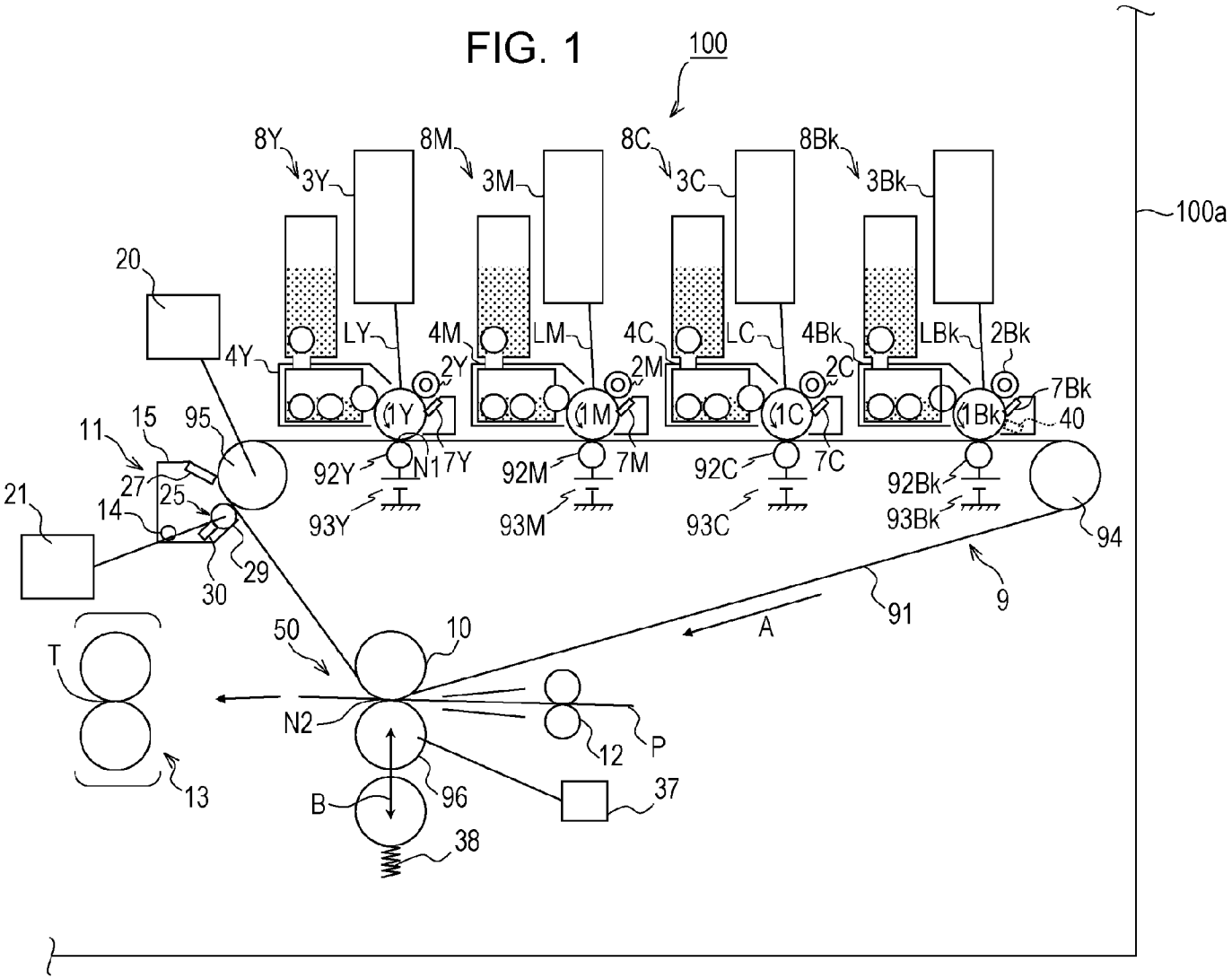
FIG. 1 is a schematic diagram illustrating an exemplary configuration of an image forming apparatus according to a first embodiment of the present invention.

Embodiments of the present invention will be described below with reference to the drawings. The same reference numerals designate the same or equivalent parts throughout the drawings. Although the embodiments will be described mainly with respect to parts relating to a lubricant applying device, the present invention is applicable to a variety of applications including a printer, various printing machines, a copier, a fax machine, and a multi-function machine by adding necessary devices, equipment, and a casing.

Image Forming Apparatus

An image forming apparatus 100 according to a first embodiment will now be described with reference to FIG. 1. FIG. 1 schematically illustrates an exemplary configuration of the image forming apparatus 100 according to the present embodiment as viewed from the front.

In this embodiment, the image forming apparatus 100 is, for example, a color laser printer which uses a transfer electrophotographic process, a contact charging method, and a two-component developing method, handles a maximum sheet size of A3, and has a resolution of 600 dpi. The image forming apparatus 100 can form a color image on a printing medium, such as a cut sheet having an average basis weight ranging from 64 to 209 g/cm$^2$ or an OHT sheet, in accordance with image information from an external host device communicatably connected to an image forming apparatus main body 100*a*, and output the image.

The image forming apparatus main body (hereinafter, referred to as the "apparatus main body") 100*a* accommodates an intermediate transfer belt unit 9 including an intermediate transfer belt (ITB) 91, serving as a rotatable image-bearing member that bears a toner image. The ITB unit 9 includes image forming portions 8Y, 8M, 8C, and 8Bk arranged in series along a lower conveying surface of the ITB 91 in that order from an upstream side in a conveying direction. These image forming portions 8Y to 8Bk form toner images of different colors, yellow (Y), magenta (M), cyan (C) and black (Bk) on the ITB 91 driven and conveyed.

In the embodiment, the image forming portions 8Y to 8Bk for yellow (Y), magenta (M), cyan (C) and black (Bk) have the same configuration, except for the color of a developer used. In the following description, components of the image forming portions will be collectively referred without characters Y, M, C, and Bk, added to the reference numerals, indicating the components of the image forming portions unless otherwise distinguished from one another.

The image forming portions 8Y, 8M, 8C, and 8Bk, each having a configuration in the form of a process cartridge, include drum-shaped electrophotographic photosensitive members (hereinafter, referred to as "photosensitive drums") 1Y, 1M, 1C, and 1Bk, respectively. The photosensitive drums 1 (1Y to 1Bk) are rotated counterclockwise in FIG. 1.

The ITB unit 9 includes a secondary inner transfer roller 10, a drive roller 95, and a tension roller which are arranged in a predetermined positional relationship. The ITB 91, serving as an endless belt, is stretched (or supported) by these rollers 10, 94, and 95 such that the belt is rotatable in a circumferential direction (indicated by an arrow A). The tension roller 94 applies outward tensile force (tensional force) to the ITB 91.

Primary transfer rollers 92Y, 92M, 92C, and 92Bk are arranged between the drive roller 95 and the tension roller 94 on an inner periphery of the ITB 91. Bias applying units (not illustrated) apply primary transfer bias to these primary transfer rollers 92Y to 92Bk. The photosensitive drums 1Y to 1Bk are opposed to the primary transfer rollers 92Y to 92Bk, respectively, with the ITB 91 therebetween. The primary transfer rollers 92Y to 92Bk press a back surface (or inner surface) of the ITB 91, so that an outer surface of the ITB 91 is in contact with the photosensitive drums 1Y to 1Bk in the image forming portions 8Y to 8Bk.

Each of the photosensitive drums 1Y to 1Bk and the ITB 91 form a primary transfer nip N1 therebetween. A toner image is transferred from each of the photosensitive drums 1Y to 1Bk to the ITB 91 at the primary transfer nip N1 at which the ITB 91 is in contact with the photosensitive drum. The secondary inner transfer roller allows the ITB 91 to rotate in the same direction as counterclockwise rotation of the secondary inner transfer roller 10. Rotation speed of the ITB 91 is set to substantially the same as that (process speed) of the photosensitive drums 1Y to 1Bk.

Figure 2:
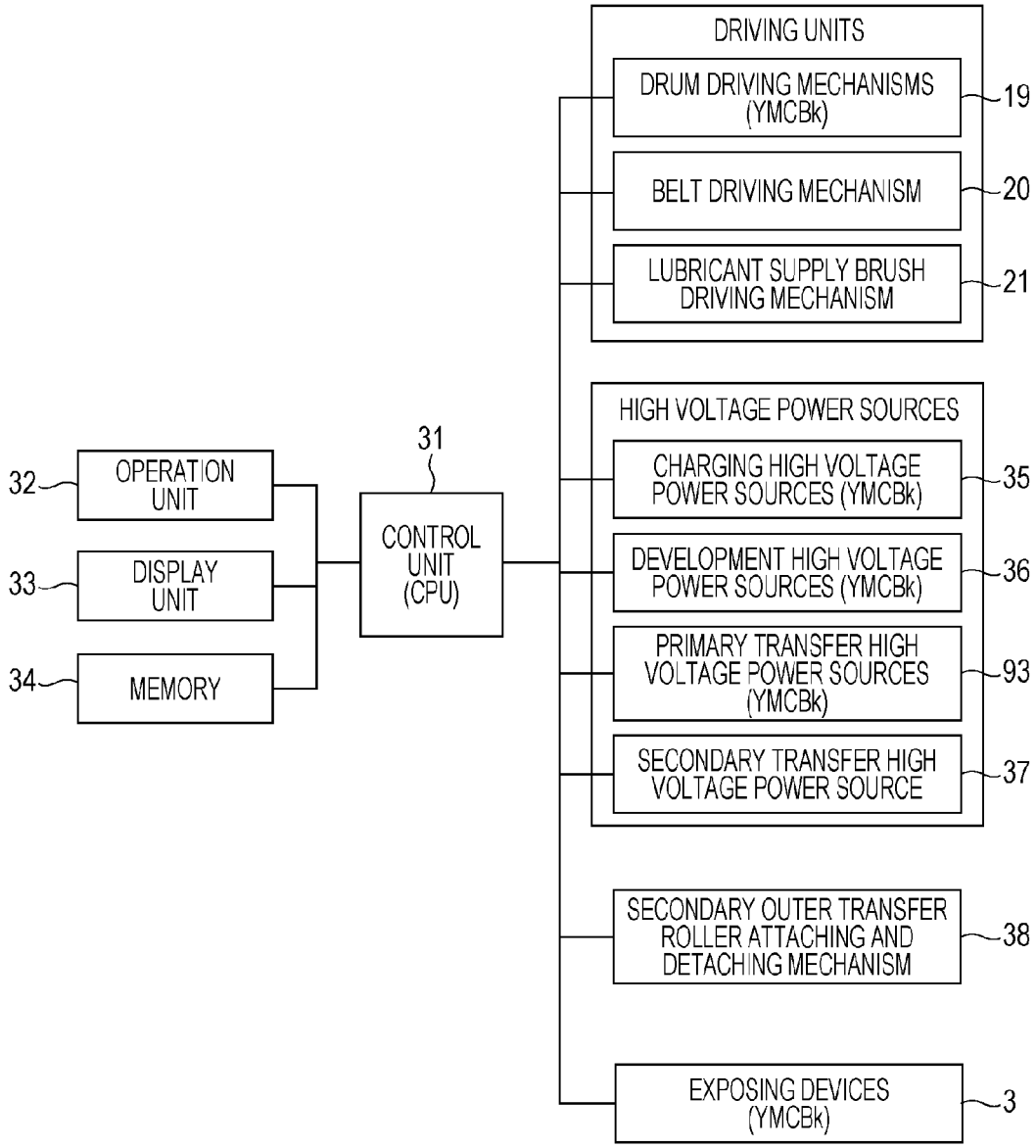
FIG. 2 is a block diagram illustrating a control system of the image forming apparatus according to the first embodiment.

Each of the photosensitive drums 1Y to 1Bk is driven and rotated counterclockwise, indicated by arrows in FIG. 1, about its axis at the process speed by a drum driving mechanism 19 (refer to FIG. 2). The ITB 91 is driven and rotated in the direction indicated by the arrow A in FIG. 1 at the same speed as the process speed of the photosensitive drums 1 by a belt driving mechanism 20. As regards the driving mechanisms 19 and 20 in the embodiment, DC brushless motors are used.

As regards the ITB 91, a resin belt, a metal-reinforced rubber belt, or a belt made of resin and rubber can be used. Alternatively, a belt including an elastic layer may be used in consideration of improvement of image quality, for example, to overcome toner scattering or transfer skip. The embodiment uses a resin belt having a volume resistivity on the order of $10^8$ Ωcm controlled by dispersing carbon into polyimide (PI). This belt has a thickness of 50 μm, a width of 340 mm, and a circumference of 1000 mm.

In the vicinity of each of the photosensitive drums 1Y to 1Bk, a charging roller 2 (2Y, 2M, 2C, 2Bk), serving as a charging member, and an exposing device 3 (3Y, 3M, 3C, 3Bk), serving as an exposing unit, are arranged in that order in a rotating direction of the photosensitive drum. The charging rollers 2 (2Y to 2Bk) are placed downstream of drum cleaning blades 7 (7Y to 7Bk) of the photosensitive drums 1 (1Y to 1Bk) in the rotating direction, respectively. The charging rollers 2 (2Y to 2Bk) are in contact with the photosensitive drums 1Y to 1Bk, respectively, thus charging the drums. In FIG. 1, the exposing devices 3Y, 3M, 3C, and 3Bk emit laser beams LY, LM, LC, and LBk, respectively.

Additionally, a development device 4 (4Y, 4M, 4C, 4Bk) and the drum cleaning blade 7 (7Y, 7M, 7C, 7Bk) for removing residual toner on the corresponding one of the photosensitive drums 1Y to 1Bk after primary transfer of a toner image are arranged in the vicinity of each of the photosensitive drums 1Y to 1Bk.

The exposing devices 3Y to 3Bk receive yellow, magenta, cyan, and black image signals, respectively, and irradiate surfaces of the photosensitive drums 1Y to 1Bk with laser beams in accordance with the image signals to neutralize charge, thus forming electrostatic latent images.

A secondary outer transfer roller 96 is disposed on the outer surface of the ITB 91 such that the secondary outer transfer roller 96 is opposed to the secondary inner transfer roller 10, with the ITB 91 therebetween. The ITB is sandwiched between the secondary outer transfer roller 96 and the secondary inner transfer roller 10. The secondary outer transfer roller 96 and the ITB 91 form a secondary transfer nip (transfer position) N2 therebetween. Specifically, the secondary outer transfer roller 96 is attachable to and detachable from the ITB 91 in a direction indicated by arrows B in FIG. 1. A control unit 31, serving as a controller, controls a secondary outer transfer roller attaching and detaching mechanism 38 such that the secondary outer transfer roller 96 is in contact with the ITB 91 only during image output. In the embodiment, a secondary transfer unit 50 serves as a transfer unit that transfers toner images on the ITB 91 (image-bearing member) to a printing medium P passing through the secondary transfer nip (transfer position) N2.

The secondary transfer unit 50 secondarily transfers the toner images formed on the ITB 91 to the printing medium (sheet) P conveyed from a sheet feed cassette (not illustrated). A positive bias is applied to the secondary outer transfer roller 96 in the secondary transfer unit 50. Applying the positive bias to the secondary transfer unit 50 through the secondary outer transfer roller 96 causes the toner images of four colors on the ITB 91 to be secondarily transferred to the printing medium P conveyed by a pair of registration rollers 12 synchronously with the toner images on the ITB 91.

A belt cleaner 11 includes a belt cleaning blade 27 disposed in contact with the outer surface of the ITB 91 such that the belt cleaning blade 27 is opposed to the drive roller 95, with the ITB 91 therebetween.

Specifically, the belt cleaning blade 27 disposed in contact with the ITB 91 removes transfer residual toner, which has not been transferred to the printing medium P in the secondary transfer unit 50 and remains on the ITB 91, in preparation for the next image formation. As regards a material for the belt cleaning blade 27, the belt cleaning blade 27 is made of urethane rubber. The belt cleaning blade 27 is disposed downstream of the secondary transfer unit 50 in the rotating direction of the ITB 91 and serves as a cleaning member that rubs against the ITB 91 and scrapes away transfer residual toner from the ITB 91.

In the embodiment, a stainless used steel (SUS) shaft having a diameter of, for example, 6 mm and wounded with a brush can be used as a lubricant supply brush 29. The lubricant supply brush 29 can be rotated relative to the outer surface of the ITB 91 at any linear velocity ranging from 0 to 500 mm/s by a lubricant supply brush driving mechanism 21. In the embodiment, the lubricant supply brush 29 is rotated in the same direction as the ITB 91 such that the lubricant supply brush 29 and the ITB 91 rotate together in contact with each other. Speed control or the like of the lubricant supply brush 29 will be described later.

As regards fibers included in the lubricant supply brush 29, for example, nylon having a denier of 2 d, a density of 430 kF/inch$^2$, an original yarn resistance of $10^{11}$Ω, and a pile length of 2.5 mm can be used. The lubricant supply brush 29 is disposed in contact with the ITB 91 such that the lubricant supply brush 29 enters the ITB 91 by, for example, 1.0 mm.

As a lubricant, for example, salt of fatty acid or fluorine-based resin in powder form or block form obtained by solidifying a powdery lubricant can be used. In particular, metal salt of higher fatty acid (so-called "metallic soap"), such as zinc stearate or calcium stearate, can be used. The embodiment uses a block (solid lubricant block 30) of zinc stearate that is easy to process into a block shape. In the embodiment, the solid lubricant block 30 is pressed against the lubricant supply brush 29 in a direction normal thereto at a total pressure of 200 g by a pressing member 16 (refer to FIG. 5).

Figure 5:
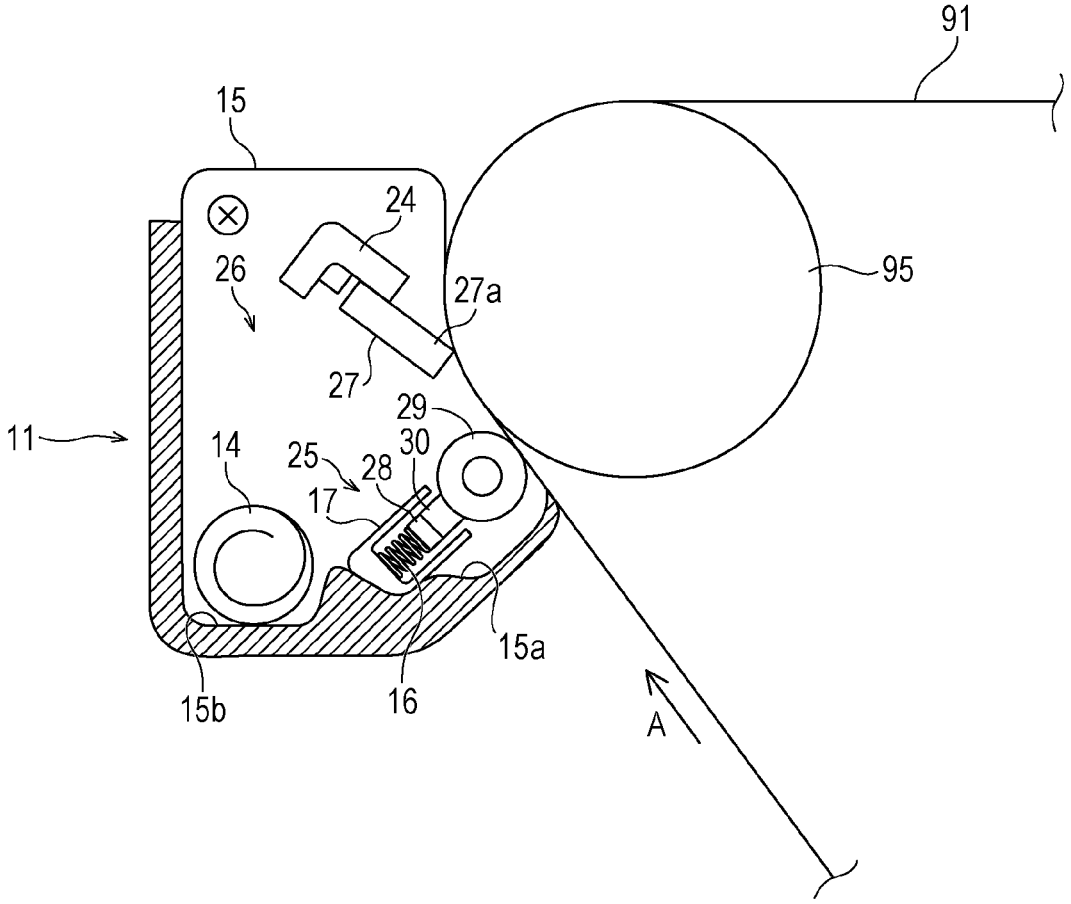
FIG. 5 is an enlarged view illustrating a belt cleaner in the first embodiment.

The belt cleaner 11 including a lubricant applying device 25 will now be described in detail with reference to FIG. 5. FIG. 5 is an enlarged view illustrating the belt cleaner 11 in the embodiment.

The belt cleaner 11, which is disposed on the ITB in the vicinity of the drive roller 95, includes a casing 15, the lubricant applying device 25, and a belt cleaning unit 26. The casing 15 accommodates the lubricant applying device 25 and the belt cleaning unit 26. The lubricant applying device 25 is disposed upstream of the belt cleaning unit 26 in the rotating direction (indicated by the arrow A) of the ITB 91. Specifically, the lubricant applying device 25 is placed between the secondary transfer unit 50 and the belt cleaning blade 27 and functions as a lubricant applying unit that applies the lubricant to the ITB 91. The lubricant supply brush driving mechanism 21 (refer to FIGS. 1 and 2) functions as a driving unit that drives the lubricant applying device 25 to apply the lubricant to the ITB 91.

The belt cleaning unit 26 includes a collected toner conveying screw 14 disposed in lower part of the casing 15, the belt cleaning blade 27 disposed in upper part of the casing 15, and a supporting member 24 supporting the blade 27 in the casing 15. The supporting member 24 is pivoted and urged by a torsion spring (not illustrated) in a direction in which a tip 27*a* of the belt cleaning blade 27 is pressed against the ITB 91. The belt cleaning blade 27 is pressed against the drive roller 95 with the ITB 91 therebetween such that the tip 27*a* faces the upstream side in the rotating direction of the ITB 91. Transfer residual toner removed from the ITB 91 by the belt cleaning blade 27 falls to a bottom recess 15*b* of the casing 15 and is then conveyed to a toner collecting unit (not illustrated) by the collected toner conveying screw 14.

The lubricant applying device 25 includes a supporting member 17 disposed near a bottom 15*a* of the casing 15 and the lubricant supply brush 29 in contact with the ITB 91 in the vicinity of lower part of the drive roller 95. The lubricant supply brush 29 extends in a direction into and out of the page of FIG. 5. The supporting member 17 receives the pressing member 16, such as a compression spring, having one end supported at a bottom of the supporting member 17. The other end of the pressing member 16 supports a holding member 28 holding the solid lubricant block 30. Consequently, the solid lubricant block 30 held by the holding member 28 is urged into pressure contact with the lubricant supply brush 29 by the pressing member 16. The solid lubricant block 30 is elongated along the axis of the lubricant supply brush 29, such that the solid lubricant block 30 held by the holding member 28 which extends along the axis of the lubricant supply brush 29 extending into and out of the page of FIG. 5 can axially contact the lubricant supply brush 29.

Specifically, the lubricant applying device 25 includes the solid lubricant block (solid lubricant) 30 and the lubricant supply brush (rotating brush) 29 rotatably rubbing against the ITB 91 while being in contact with the solid lubricant block 30. The above-described simple configuration achieves such a lubricant applying unit. The lubricant supply brush 29 is driven and rotated by the lubricant supply brush driving mechanism 21 (refer to FIG. 2). The control unit 31 (see FIG. 2) controls the lubricant supply brush driving mechanism 21 to change the rotation speed of the lubricant supply brush 29.

With the above-described configuration, the lubricant supply brush 29 can contact the ITB 91 while being in contact with the solid lubricant block 30 pressed, and supply (apply) the lubricant to the ITB 91 rotating and moving. Consequently, the lubricant applied by the lubricant supply brush 29 reduces a friction coefficient of the outer surface of the ITB 91 and, after that, transfer residual toner remaining on the ITB 91 after secondary transfer by the secondary transfer unit 50 is smoothly removed by the belt cleaning blade 27.

Referring to FIG. 1, a fixing device 13 is disposed downstream of the secondary transfer unit 50 in the conveying direction of printing media. In addition, a pair of sheet discharge rollers and an output tray, which are not illustrated, are arranged downstream of the fixing device 13. The printing medium P, to which the toner images have been secondarily transferred by the secondary transfer unit 50, is conveyed to a fixing nip T of the fixing device 13 and is heated and pressed, so that the toner images are melted and fixed to the printing medium P.

In addition, a sheet feeding unit (not illustrated) including a sheet cassette (not illustrated) receiving a stack of printing media P to be used for image formation is disposed in lower part of the apparatus main body 100*a*. The sheet feeding unit separates the printing media P, fed by a sheet feeding roller (not illustrated), one by one and conveys the printing medium P to the pair of registration rollers 12.

Operation of Image Forming Apparatus

In the image forming apparatus 100, a yellow toner image is formed on the photosensitive drum 1Y and is then transferred to the ITB 91 in the image forming portion 8Y. In the image forming portion 8M, a magenta toner image is formed in a manner similar to the image forming portion 8Y and is then superposed and transferred onto the yellow toner image on the ITB 91. In the image forming portions 8C and 8Bk, a cyan toner image and a black toner image are formed in a manner similar to the image forming portion 8Y and are then sequentially transferred to the ITB 91 in a superposed manner.

The toner images of four colors on the ITB 91 are conveyed to the secondary transfer unit 50 and are then collectively secondarily transferred to the printing medium P conveyed through the pair of registration rollers 12. The printing medium P with the secondarily transferred toner images of the four colors is separated from the ITB 91 and is then fed to the fixing device 13. The printing medium P is heated and pressed at the fixing nip T of the fixing device 13 to melt the toner, so that an image is fixed to the surface of the printing medium P. After that, the printing medium P is discharged to the output tray through the pair of sheet discharge rollers (not illustrated).

Control System

A control system of the image forming apparatus 100 according to the embodiment will now be described with reference to FIG. 2.

Referring to FIG. 2, the control unit 31 including a central processing unit (CPU), a random access memory (RAM), and a read-only memory (ROM) is connected to an operation unit 32, a display unit 33, and a memory 34 which information can be stored to and read from. The operation unit 32 is disposed in, for example, upper part of the apparatus main body 100*a*. The display unit 33 is disposed adjacent to the operation unit 32.

The control unit 31 is connected to the drum driving mechanisms 19 for driving the photosensitive drums 1, the belt driving mechanism 20 for driving the ITB 91, and the lubricant supply brush driving mechanism 21 for driving the lubricant supply brush 29. The control unit 31 outputs drive instructions and stop instructions to the drum driving mechanisms 19, the belt driving mechanism 20, and the lubricant supply brush driving mechanism 21. In addition, the control unit 31 sets a power value of each of charging high voltage power sources 35, development high voltage power sources 36, primary transfer high voltage power sources 93, and a secondary transfer high voltage power source 37, and outputs power supply instructions and stop instructions to these power sources. Furthermore, the control unit 31 is connected to the secondary outer transfer roller attaching and detaching mechanism 38 for controlling attachment and detachment of the secondary outer transfer roller 96 and the exposing devices 3 (3Y to 3Bk) such that the control unit 31 can control the mechanism 38 and the devices 3.

In the embodiment, when downtime, during which image formation is interrupted while the ITB 91 is rotated, is longer than or equal to a predetermined set period during successive image formation during which toner images are successively formed, the control unit 31 controls the amount of lubricant applied in the following manner. Although the amount of lubricant applied is controlled during successive image formation in the embodiment, the control may be performed in any other suitable manner. The control can be performed during, for example, pre-rotation before image formation or post rotation after image formation. In this case, the same advantages as those in the control during successive image formation can be obtained.

As used herein, the term "downtime" refers to a period during which image formation is interrupted while an interval (sheet-to-sheet interval) between the printing media P conveyed is passing through the secondary transfer nip (transfer position) N2 in a rotating state of the ITB during image formation. In other words, the term "downtime" refers to a period during which an area corresponding to the interval between the printing media P passes through the secondary transfer nip (transfer position) N2.

Specifically, in the embodiment, the "downtime" (Tdown) is provided as a period required for an adjusting operation which is typically performed while image formation is interrupted during image formation. The set period (Tstop) is a period previously set and stored in the memory 34. If the downtime is longer than or equal to the set period, the control unit 31 controls the lubricant supply brush driving mechanism 21 such that the amount of lubricant applied by the lubricant applying device 25 is at least lower than that in a case where the downtime Tdown is shorter than the set period Tstop.

The above-described "controlling the lubricant supply brush driving mechanism 21 to achieve at least a reduction in the amount of lubricant applied" in the embodiment means that the lubricant supply brush driving mechanism 21 is stopped (turned off) if the downtime is longer than or equal to the set period. The control may be performed in any other suitable manner. The lubricant supply brush driving mechanism 21 can be controlled in such a manner that the lubricant supply brush driving mechanism 21 is not stopped and the rotation speed of the lubricant supply brush 29 is reduced to reduce the amount of lubricant applied.

In the embodiment (and a second embodiment), the lubricant supply brush 29 is configured such that the linear speed thereof reaches 0 (or stops) during downtime (or during non-sheet supply). If blade torque can be lower than a value at which blade chattering or blade turn-up is caused, the lubricant supply brush driving mechanism 21 can be controlled such that the lubricant supply brush 29 is rotated at a lower speed than that during sheet supply without being stopped at a linear speed of 0 during non-sheet supply. In this case, substantially the same advantages as those at a linear speed of 0 can be obtained.

Image Forming Process and Lubricant Applying Process

Figure 3A:
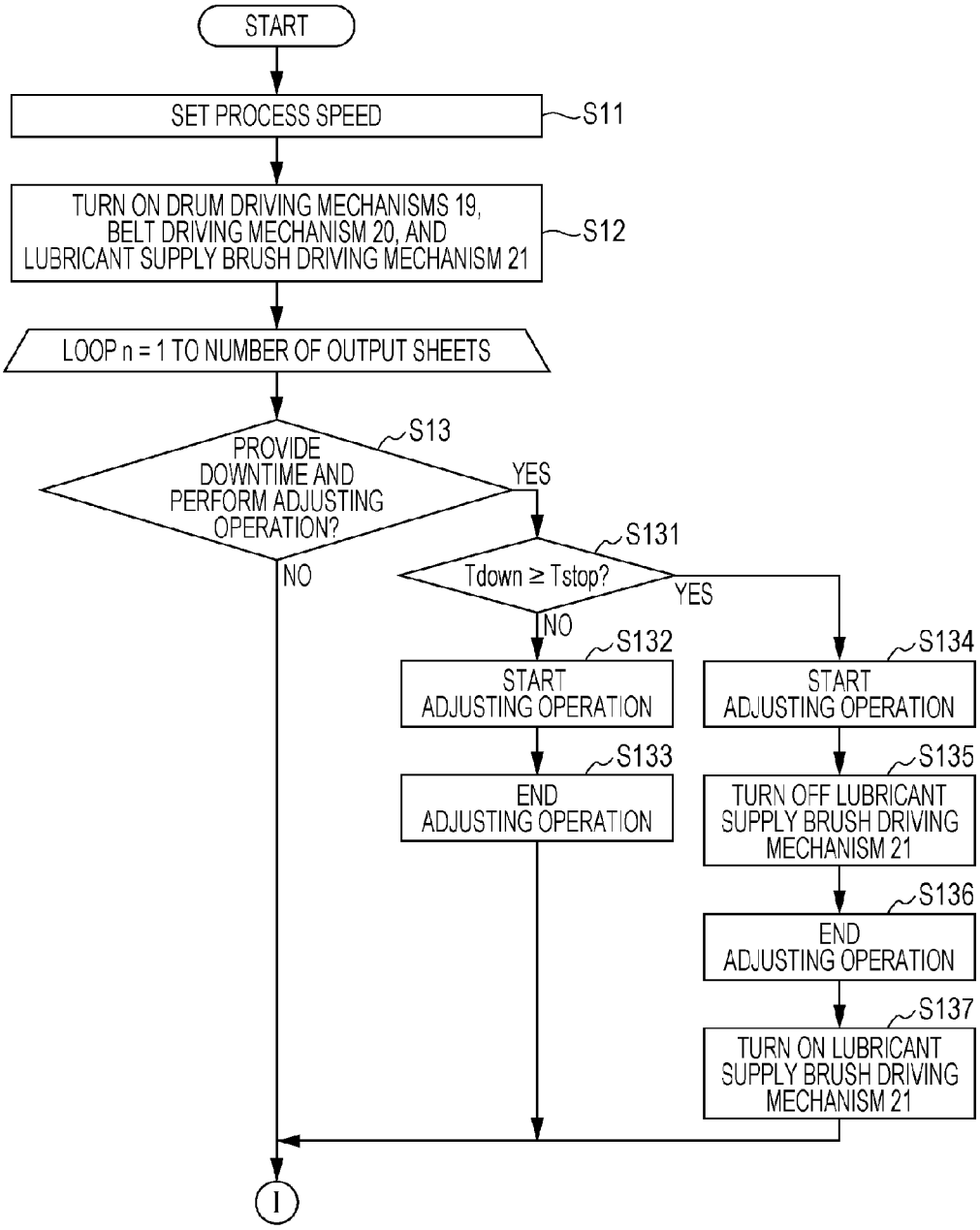
FIGS. 3A and 3B illustrate a flowchart of a process for image formation in the first embodiment.
Figure 3B:
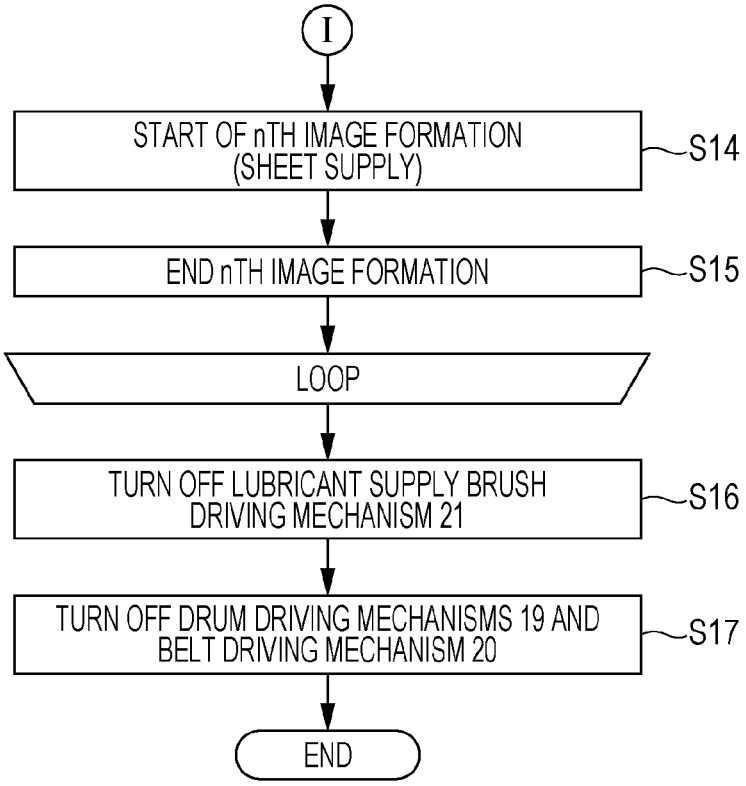

An image forming process and a lubricant applying process in the embodiment will now be described with reference to FIGS. 3A and 3B.

The control unit 31 sets the process speed of the photosensitive drums 1 and the ITB 91 to, for example, 250 mm/s, and sets the linear speed of the lubricant supply brush 29 to, for example, 200 mm/s (S11). The control unit 31 then drives (or turns on) the drum driving mechanisms 19 for the photosensitive drums 1, the belt driving mechanism 20 for the ITB 91, and the lubricant supply brush driving mechanism 21 for the lubricant supply brush 29 (S12).

The control unit 31 determines whether to provide downtime (the period during which image output is not permitted because of an adjusting operation or the like) and perform the adjusting operation of the image forming apparatus 100 (S13). When determining to perform the adjusting operation, the control unit 31 determines whether the period (downtime Tdown) required for the adjusting operation is longer than or equal to the set period Tstop (S131).

In the adjusting operation in the embodiment, for example, if toner addition is not enough to form an image which requires a large amount of toner, image formation may be temporarily stopped and sheet supply may be interrupted during such a period. If temperature adjustment for the fixing device 13 is late, sheet supply may be interrupted. In the embodiment, the rotation speed of the lubricant supply brush 29 is controlled to reduce the amount of lubricant supplied (applied) to the belt cleaning blade 27 if sheet supply is interrupted.

Figure 4:
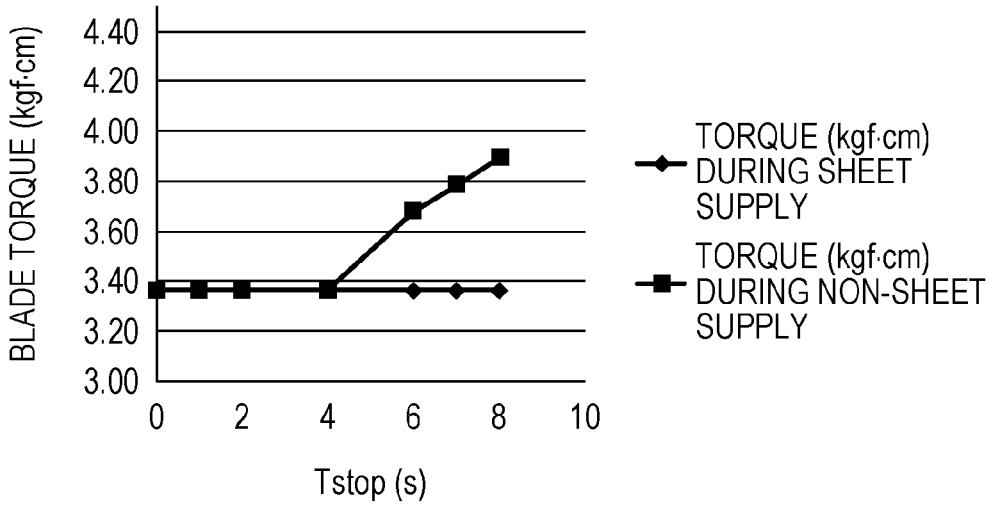
FIG. 4 is a graph illustrating changes in blade torque plotted against a set period Tstop in the first embodiment.

FIG. 4 illustrates blade torque during non-sheet supply plotted against the set period Tstop varied in the embodiment. FIG. 4 demonstrates that whereas torque during sheet supply was substantially constant, the torque during non-sheet supply increased when the value Tstop exceeded four seconds corresponding to one rotation of the ITB 91. If the set period Tstop is shortened, a stop operation would often be performed. The amount of lubricant applied may become unstable.

Abnormal sound accompanied blade chattering occurred when the blade torque exceeded 3.5 kgf·cm. The blade torque accordingly has to be lower than that value. Consequently, the set period Tstop=4 s in the embodiment.

If the downtime Tdown is shorter than the set period Tstop (NO in S131), the control unit 31 maintains an ON state of the lubricant supply brush driving mechanism 21 to continue rotation of the lubricant supply brush 29 from the start (S132) of the adjusting operation to the end (S133) thereof.

If Tdown≥Tstop (YES in S131), the control unit 31 starts the adjusting operation (S134) and turns off the lubricant supply brush driving mechanism 21 to stop rotation of the lubricant supply brush 29 (S135). The control unit 31 performs the adjusting operation and then ends the adjusting operation (S136). After that, the control unit 31 again turns on the lubricant supply brush driving mechanism 21 to rotate the lubricant supply brush 29 (S137).

Upon turn-on of the lubricant supply brush driving mechanism 21 for the lubricant supply brush 29 after the adjusting operation, the control unit 31 starts image formation and allows sheet supply (S14). After that, the control unit 31 determines whether to provide downtime and perform the adjusting operation (S13) each time image formation is completed (S15).

If the number of image formation completions reaches a set number of output sheets, the control unit 31 turns off the lubricant supply brush driving mechanism 21 (S16) and then turns off the drum driving mechanisms 19 for the photosensitive drums 1 and the belt driving mechanism 20 for the ITB 91 (S17). Then, the control unit 31 ends the process.

If the lubricant is applied to the ITB 91 during sheet supply, the lubricant will move to (or deposit on) a printing medium, so that part of the lubricant supplied to the ITB 91 will be supplied to the belt cleaning blade 27. If the control for extending the sheet-to-sheet interval is performed, the whole of the lubricant supplied to the ITB would be supplied to the belt cleaning blade 27. Consequently, the lubricant would be excessively supplied and the blade torque would increase too high. This may cause blade chattering or blade turn-up.

In the embodiment, therefore, the lubricant supply by the lubricant applying device 25 is reduced during non-sheet supply to avoid excessive supply of the lubricant. Specifically, the lubricant is not applied (or reduced) during non-sheet supply to prevent the lubricant from being excessively supplied to the nip between the belt cleaning blade 27 and the ITB 91. This prevents a phenomenon of blade torque increase caused by excessive supply of the lubricant. Consequently, since the lubricant is prevented from being excessively supplied to the belt cleaning blade 27 during downtime, frictional force can be stabilized, thus preventing blade chattering, blade turn-up, or the like.

The control unit 31 can control the amount of lubricant applied in accordance with the following modification. In other words, the following control can be performed when an idle rotation mode in which the ITB 91 is idly rotated during non-image formation, during which no image is formed. Specifically, the control unit (controller) 31 controls the lubricant supply brush driving mechanism 21 such that the amount of lubricant applied by the lubricant applying device 25 is at least lower than that before the idle rotation mode (namely, in a case where toner images pass through the transfer position (N2) during normal image formation). In this case, controlling the lubricant supply brush driving mechanism 21 to achieve at least a reduction in the amount of lubricant applied involves control for stopping the lubricant supply brush driving mechanism 21 and control for reducing the rotation speed of the lubricant supply brush 29 to reduce the amount of lubricant applied.

The above-described control of the amount of lubricant applied in this modification is effective in the idle rotation mode executed in a case where downtime is known in advance, for example, during electric discharge current control, active transfer voltage control (ATVC), or adjustment and alteration of fixing temperature. Furthermore, this control is effective in the idle rotation mode executed in a case where downtime is unknown, for example, during image data conversion. In the idle rotation mode (during non-sheet supply) during which the lubricant is not taken away by printing media, reducing the amount of lubricant applied or stopping application of the lubricant prevents any trouble, e.g., blade turn-up, while idle rotation of the ITB 91 is being continued.

Second Embodiment

An image forming apparatus 100 according to a second embodiment of the present invention will be described with reference to FIGS. 6A to 8 and Tables 1 and 2. As regards the configurations illustrated in FIGS. 1, 2, and 5, the same applies to the second embodiment. As regards control by a control unit 31 in the second embodiment, the control unit 31 performs control steps S211 to S234 in FIG. 6A in addition to control steps S24 to S30 which are similar to the control steps in FIGS. 3A and 3B. In the second embodiment, the same components as those in the first embodiment are designated by the same reference numerals and a description of the previously described components and functions is omitted.

A printing medium P should be heated in order to melt toner in the fixing device 13. There is an upper limit to the amount of heat given per unit time. In supplying thick paper or an OHT sheet, therefore, process speed is generally reduced.

The image forming apparatus 100 according to the second embodiment has a reduced speed mode (refer to Table 1) in which process speed is reduced to 125 mm/s, which is half the normal process speed, in terms of fixability. The image forming apparatus 100 according to the present embodiment is configured such that a user or the like can select any of plain paper, recycled paper, thick paper, and an OHT sheet as the type of a printing medium P to be supplied on the operation unit 32. Table 1 illustrates blade torque (kgf·cm) during supply of the thick paper and that during supply of the OHT sheet in the embodiment.

TABLE 1

(i) Process Speed of 125 mm/s

| Lubricant Supply | Blade Torque (kgf · cm) | |
|---|---|---|
| Brush Speed (mm/s) | Thick Paper | OHT Sheet |
| 125 | 3.47 | 3.68 |
| 100 | 3.36 | 3.58 |
| 50 | 3.58 | 3.36 |
| 0 | 3.89 | 4.21 |

In the embodiment, the plain paper is defined as a sheet of paper having an average basis weight ranging from 64 to 105 g/m$^2$ and a smoothness greater than or equal to 70 s, the recycled paper is defined as a sheet of paper having an average basis weight ranging from 64 to 105 g/m$^2$ and a smoothness less than 20 s, the thick paper is defined as a sheet of paper having an average basis weight greater than 105 g/m$^2$, and the OHT sheet is defined as a sheet having a thickness of 100 μm.

Blade torque during supply of each of these sheets will now be described with reference to Table 2. Table 2 illustrates blade torque during supply of the plain paper and that during supply of the recycled paper in the embodiment. A sheet of paper having a smooth surface takes away (or permits deposition thereon of) more lubricant from the ITB 91 (or the photosensitive drums 1), serving as an image-bearing member, than the plain paper and the recycled paper. A sheet of paper having a rough surface, for example, the plain paper or the recycled paper, takes away little lubricant from the ITB 91 (or the photosensitive drums 1). The blade torque accordingly varies depending on the speed of the lubricant supply brush 29. Furthermore, the blade torque increases when the amount of lubricant applied is insufficient. As a result, rotation speed is set to achieve minimum torque for each sheet.

TABLE 2

| (ii) Process Speed of 250 mm/s | | |
|---|---|---|
| Lubricant Supply | Blade Torque (kgf · cm) | |
| Brush Speed (mm/s) | Plain Paper | Recycled Paper |
| 250 | 3.58 | 3.68 |
| 200 | 3.36 | 3.58 |
| 150 | 3.47 | 3.36 |
| 100 | 3.58 | 3.47 |
| 50 | 3.68 | 3.58 |
| 0 | 4.00 | 4.00 |

In the embodiment, the following speeds are set as illustrated in Table 2. Specifically, the process speed is set to 250 mm/s and the linear speed of the lubricant supply brush 29 is set to, for example, 200 mm/s for the plain paper. In addition, the process speed is set to 250 mm/s and the linear speed of the lubricant supply brush 29 is set to, for example, 150 mm/sec for the recycled paper.

Furthermore, the following speeds are set as illustrated in Table 1. The process speed is set to 125 mm/s and the linear speed of the lubricant supply brush 29 is set to, for example, 100 mm/s for the thick paper. Additionally, the process speed is set to 125 mm/s and the linear speed of the lubricant supply brush 29 is set to, for example, 50 mm/s for the OHT sheet.

In the embodiment, the control unit 31 controls the lubricant supply brush driving mechanism 21 such that the amount of lubricant applied by the lubricant applying device 25 varies depending on the type of a printing medium passing through the secondary transfer nip (transfer position) N2. The memory 34 (refer to FIG. 2) in the embodiment stores printing medium type information input from the operation unit 32. The control unit 31 reads the printing medium type information from the memory 34 and controls the amount of lubricant applied in accordance with the information such that the amount of lubricant applied is smaller as a printing medium allows more lubricant to deposit on the ITB 91. In other words, the amount of lubricant applied is controlled such that the amount of lubricant applied for the plain paper>that for the recycled paper>that for the thick paper>that for the OHT sheet.

Image Forming Process and Lubricant Applying Process

Figure 6A:
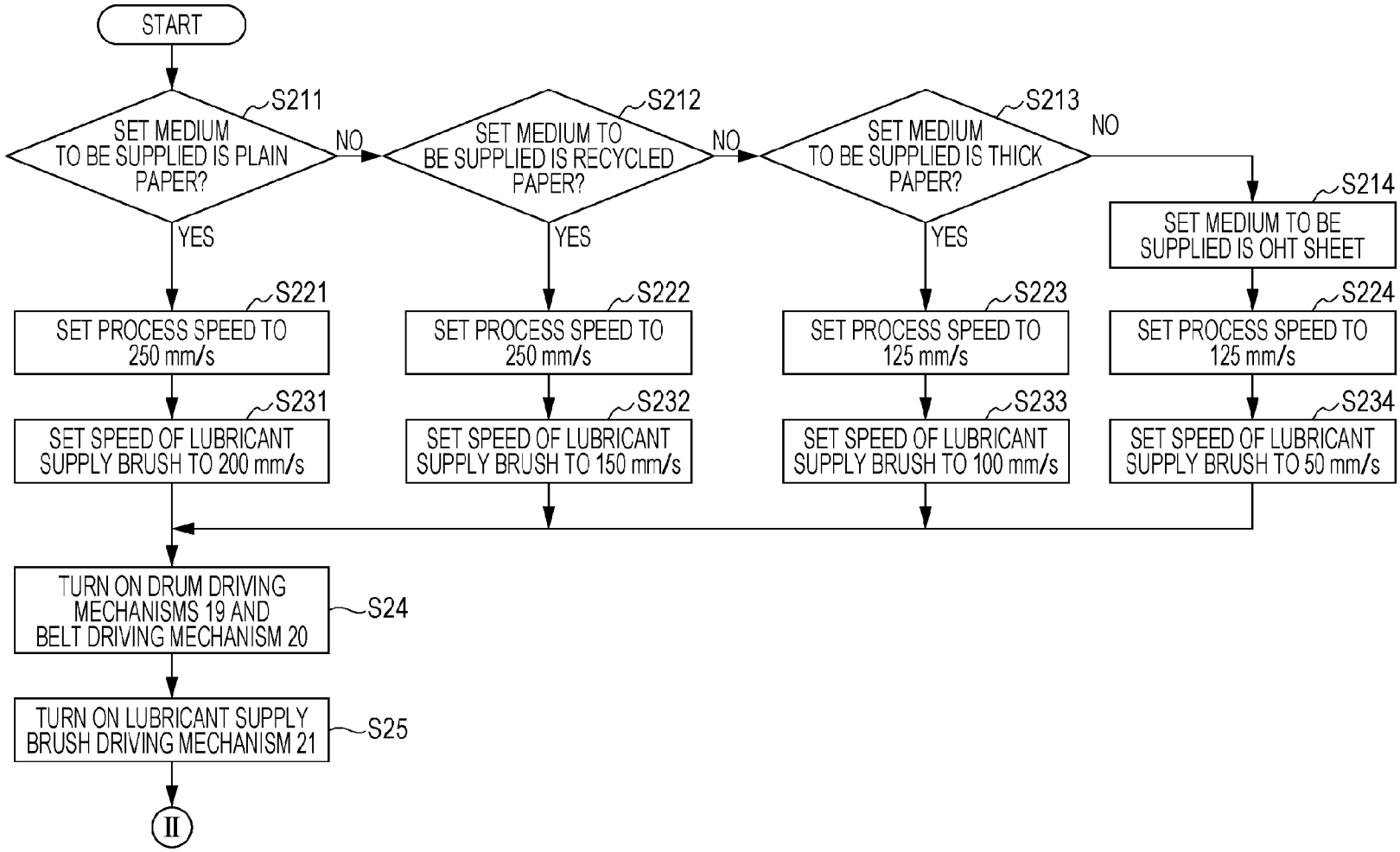

An image forming process and a lubricant applying process in the embodiment will now be described with reference to FIGS. 6A and 6B.

The control unit 31 determines the type of a printing medium P entered by the user or the like through the operation unit 32 (S211 to S214). Then, the control unit 31 sets the process speed of the photosensitive drums and the ITB 91 and the linear speed of the lubricant supply brush 29 in accordance with the type of the printing medium P to be supplied (S221 to S224, S231 to S234).

Specifically, the control unit 31 reads out printing medium type information input from the operation unit 32 and stored in the memory 34, and determines whether the printing medium to be supplied (or "medium to be supplied") is plain paper in accordance with the information (S211). If the medium to be supplied is plain paper (YES in S211), the control unit 31 sets the process speed to 250 mm/s (S221) and further sets the linear speed of the lubricant supply brush 29 to 200 mm/s (S231). Then, the control unit 31 proceeds to S24.

If the control unit 31 determines in S211 that the medium to be supplied is not plain paper (NO in S211), the control unit 31 proceeds to S212, where the control unit 31 determines whether the medium to be supplied is recycled paper. If the medium to be supplied is recycled paper (YES in S212), the control unit 31 sets the process speed to 250 mm/s (S222) and further sets the linear speed of the lubricant supply brush 29 to 150 mm/s (S232). Then, the control unit 31 proceeds to S24.

If the control unit 31 determines in S212 that the medium to be supplied is not recycled paper (NO in S212), the control unit 31 proceeds to S213, where the control unit 31 determines whether the medium to be supplied is thick paper. If the medium to be supplied is thick paper (YES in S213), the control unit 31 sets the process speed to 125 mm/s (S223) and further sets the linear speed of the lubricant supply brush 29 to 100 mm/s (S233). Then, the control unit 31 proceeds to S24.

If the control unit 31 determines in S213 that the medium to be supplied is not thick paper (NO in S213), the control unit 31 proceeds to S214, where the control unit 31 determines that the medium to be supplied is an OHT sheet. The control unit 31 sets the process speed to 125 mm/s (S224) and further sets the linear speed of the lubricant supply brush 29 to 50 mm/s (S234). Then, the control unit 31 proceeds to S24.

In S24, the control unit 31 starts driving (or turns on) the drum driving mechanisms 19 for the photosensitive drums 1 and the belt driving mechanism 20 for the ITB 91. In S25, the control unit 31 starts driving (or turns on) the lubricant supply brush driving mechanism 21 for the lubricant supply brush 29. Consequently, image formation is repeatedly performed such that the number of image formations starts from one (loop n=1) and reaches a value indicating the number of output sheets set through the operation unit 32.

In S26, the control unit 31 determines whether to provide downtime and perform the adjusting operation of the image forming apparatus 100. If the control unit 31 determines to perform the adjusting operation (YES in S26), the control unit 31 determines whether the period (Tdown) required for the adjusting operation is longer than or equal to the set period Tstop (S261).

If the control unit 31 determines that Tdown>Tstop (NO in S261), the control unit 31 maintains driving (ON state) of the lubricant supply brush driving mechanism 21 to continue rotation of the lubricant supply brush 29 from the start (S262) of the adjusting operation to the end (S263) thereof. Then, the control unit 31 proceeds to S27. If the control unit 31 determines in S26 not to perform the adjusting operation (NO in S26), the control unit 31 proceeds to S27.

On the other hand, if Tdown Tstop (YES in S261), the control unit 31 turns off the lubricant supply brush driving mechanism 21 at the start (S264) of the adjusting operation to stop rotation of the lubricant supply brush 29 (S265). In addition, the control unit 31 performs the adjusting operation and then ends the operation (S266). After that, the control unit 31 again turns on the lubricant supply brush driving mechanism 21 to rotate the lubricant supply brush 29 (S267) and then proceeds to S27.

After the adjusting operation, the control unit 31 turns on the lubricant supply brush driving mechanism 21 to drive the lubricant supply brush 29, thus starting image formation and sheet supply. Each time image formation is completed, the control unit 31 determines whether to provide downtime and perform the adjusting operation. After the start of sheet supply for nth image formation (S27), when the nth image formation is completed (S28), the number of image formations reaches the value n (loop n=n).

When the number of image formation completions reaches the set number of output sheets, the control unit 31 turns off the lubricant supply brush driving mechanism to stop the lubricant supply brush 29 (S29). In addition, the control unit 31 turns off the drum driving mechanisms 19 and the belt driving mechanism 20 to stop driving of the photosensitive drums 1 and the ITB 91.

Figure 7:
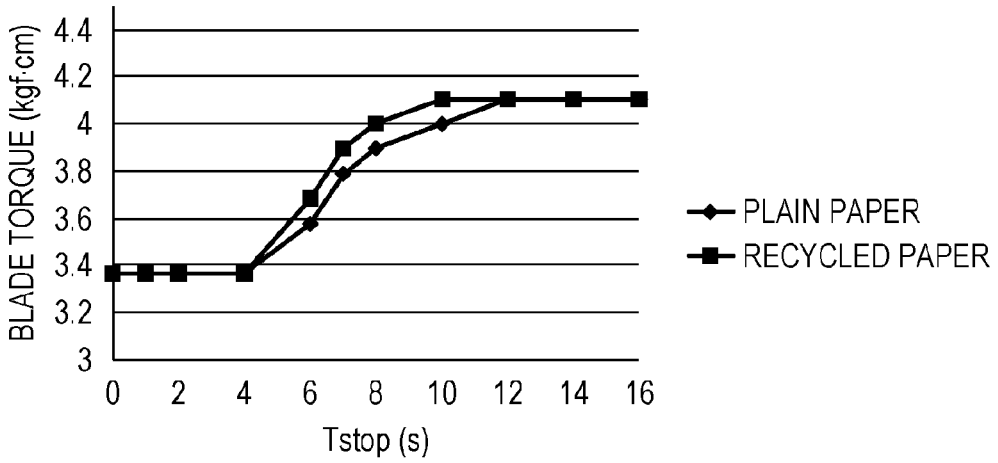
FIG. 7 is a graph illustrating changes in blade torque plotted against the set period Tstop with respect to plain paper and recycled paper in the second embodiment.
Figure 8:
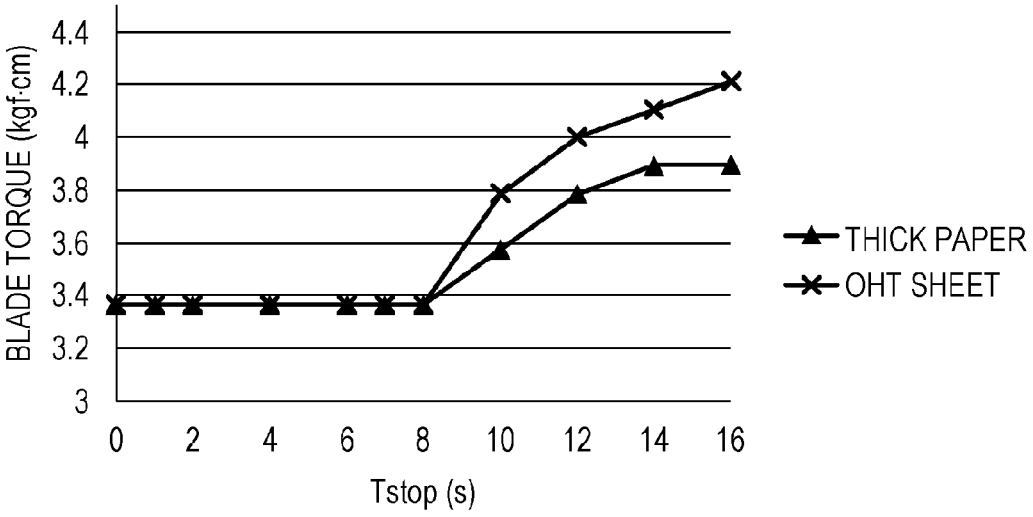
FIG. 8 is a graph illustrating changes in blade torque plotted against the set period Tstop with respect to thick paper and an OHT sheet in the second embodiment.

A change in blade torque for each type of sheet during non-sheet supply with varying Tstop in the embodiment will now be described with reference to FIGS. 7 and 8. FIGS. 7 and 8 are graphs illustrating the blade torque (kgf·cm) plotted against the set period Tstop (s). In FIG. 7, solid diamonds represent a change in blade torque for the plain paper and solid rectangles represent a change in blade torque for the recycled paper. In FIG. 8, solid triangles represent a change in blade torque for the thick paper and crisscrosses represent a change in blade torque for the OHT sheet.

FIG. 7 demonstrates that the blade torque increased at or above a Tstop value of four seconds corresponding to one rotation of the ITB 91, regardless of the type of sheet (plain paper, recycled paper). In supplying the plain paper or the recycled paper, therefore, Tstop was set to a period (four seconds) corresponding to one rotation of the ITB 91.

FIG. 8 demonstrates that the blade torque increased at or above a Tstop value of eight seconds, twice the period corresponding to one rotation of the ITB 91, regardless of the type of sheet (thick paper, OHT sheet). In supplying the thick paper or the OHT sheet, therefore, the set period Tstop was set to a period (eight seconds) corresponding to two rotations of the ITB 91.

As described above, if the set period Tstop is shortened, a stop operation would often be performed, so that the amount of lubricant applied may become unstable. The set period Tstop is therefore set such that Tstop=4 s during supply of the plain paper or the recycled paper and Tstop=8 s during supply of the thick paper or the OHT sheet.

In the embodiment, the control unit 31 controls the amount of lubricant applied in accordance with printing medium type information in such a manner that the amount of lubricant applied is smaller as a printing medium allows more lubricant to deposit on the ITB 91, namely, the amount of lubricant applied for the plain paper>that for the recycled paper>that for the thick paper>that for the OHT sheet. This prevents the lubricant from being excessively supplied to the blade nip depending on the type of medium to be supplied, thus avoiding an increase in blade torque. While printing media of different types are supplied, therefore, excessive supply of the lubricant to the belt cleaning blade 27 can be prevented to stabilize frictional force, thus preventing blade chattering, blade turn-up, or the like.

In the above-described first and second embodiments, the configuration including, as a rotating brush, the lubricant supply brush 29 which is a fur brush has been described as an exemplary configuration. The configuration may include any other suitable rotating component, such as a roller, capable of uniformly applying the lubricant to an image-bearing member, e.g., the ITB 91.

The first embodiment (and the modification) and the second embodiment have been described with respect to the case where the ITB 91 serves as an image-being member and the lubricant applying device 25 for applying the lubricant to the ITB 91 is controlled. The present invention can also be applied to an image forming apparatus configured such that the photosensitive drums 1 (1Y to 1Bk) sequentially contact directly a printing medium to achieve a transfer operation without using the ITB 91. In this case, each of the photosensitive drums 1 (1Y to 1Bk) serves as a rotatable image-bearing member that bears a toner image and each of the drum cleaning blades 7 (7Y to 7Bk) serves as a cleaning member that scrapes away transfer residual toner from the image-bearing member. A lubricant applying device 40, indicated by a dotted line in FIG. 1, serves as a lubricant applying unit that applies the lubricant to the image-bearing member. Such a configuration can offer substantially the same advantages as those in the foregoing embodiments. Although the lubricant applying device 40 is illustrated so as to correspond only to the drum cleaning blade 7Bk for the sake of convenience, the lubricant applying devices 40 are provided for the other drum cleaning blades 7Y, 7M, and 7C.

According to the present invention, the lubricant is prevented from being excessively supplied to the cleaning member during, for example, downtime or supply of printing media of different types, thus stabilizing frictional force. This can reduce blade chattering, blade turn-up, or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-121100, filed Jun. 12, 2014, which is hereby incorporated by reference herein in its entirety.

What is claimed is:

1. An image forming apparatus comprising:

a rotatable image-bearing member configured to bear a toner image;

a forming unit configured to form the toner image on the image-bearing member;

a cleaning blade configured to remove a residual toner from the image-bearing member by contacting to the image-bearing member;

a lubricant applying unit configured to apply a lubricant to the image-bearing member;

a driving unit configured to drive the lubricant applying unit; and a controller configured to control the driving unit so that an amount of a lubricant applied per unit time to the image-bearing member by the lubricant applying unit in a first time to be less than that applied per unit time in a second time when executing a job for continuously forming toner images formed on the image bearing member on a plurality of recording materials, wherein the first time is a period that is from a time point after a first recording material of the plurality of recording materials passing a transfer position where the toner images are transferred to the recording materials, until a second recording material of the plurality of recording materials which follows the first recording material reaches the transfer position, and wherein the second time is a period that is shorter than the first time.

2. The apparatus according to claim 1, wherein the controller sets the amount of lubricant applied per unit time by the lubricant applying unit based on a type of a recording material passing through the transfer position.

3. The apparatus according to claim 1, wherein the controller sets the period based on the amount of lubricant applied per unit time applied by the lubricant applying unit.

4. The apparatus according to claim 1, wherein the lubricant applying unit includes a solid lubricant and a rotating brush rotatably rubbing against the image-bearing member while being in contact with the solid lubricant, and wherein the controller changes, by changing rotation speed of the rotating brush, the amount of lubricant applied per unit time by the lubricant applying unit.

5. The apparatus according to claim 1, wherein the controller sets the period based on a type of a recording material passing through the transfer position.

6. The apparatus according to claim 1, wherein the lubricant applying unit is disposed downstream to the forming unit in a rotating direction of the image-bearing member and upstream to the cleaning blade in a rotating direction of the image-bearing member.

7. An image forming apparatus comprising:

a rotatable image-bearing member configured to bear a toner image;

a forming unit configured to form the toner image on the image-bearing member;

a cleaning blade configured to remove a residual toner from the image-bearing member by contacting to the image-bearing member;

a lubricant applying unit configured to apply a lubricant to the image-bearing member;

a first driving source;

a second driving source;

a first drive transmitting portion configured to transmit drive force supplied from the first driving source to the image-bearing member;

a second drive transmitting portion configured to transmit drive force supplied from the second driving source to the lubricant applying unit; and a controller configured to control the second driving source so that an amount of a lubricant applied per unit time to the image-bearing member by the lubricant applying unit when rotation speed of the image-bearing member is in a first speed is less than that applied per unit time when rotation speed of the image-bearing member is in a second speed that is faster than the first speed, wherein the lubricant applying unit is disposed downstream to the forming unit in a rotating direction of the image-bearing member and upstream to the cleaning blade in a rotating direction of the image-bearing member.

8. The apparatus according to claim 7, wherein the lubricant applying unit is rotatable, and wherein proportion of rotation speed of the lubricant applying unit to the rotation speed of the image-bearing member when the rotation speed of the image-bearing member is the second speed is different from proportion of rotation speed of the lubricant applying unit to the rotation speed of the image-bearing member when the rotation speed of the image-bearing member is the first speed.

9. The apparatus according to claim 7, wherein the lubricant applying unit includes a solid lubricant and a rotating brush rotatably rubbing against the image-bearing member while being in contact with the solid lubricant, and wherein the controller changes, by changing rotation speed of the rotating brush, the amount of lubricant applied per unit time by the lubricant applying unit.

10. An image forming apparatus comprising:

a rotatable image-bearing member configured to bear a toner image;

a forming unit configured to form the toner image on the image-bearing member;

a cleaning blade configured to remove a residual toner from the image-bearing member by contacting to the image-bearing member;

a rotatable lubricant applying unit configured to apply a lubricant to the image-bearing member;

a first driving source;

a second driving source;

a first drive transmitting portion configured to transmit drive force supplied from the first driving source to the image-bearing member;

a second drive transmitting portion configured to transmit drive force supplied from the second driving source to the lubricant applying unit; and a controller configured to control the second driving source so that the rotation speed of the lubricant applying unit when rotation speed of the image-bearing member is in a first speed is less than the rotation speed of the lubricant applying unit when rotation speed of the image-bearing member is in a second speed that is faster than the first speed, wherein the lubricant applying unit is disposed downstream to the forming unit in a rotating direction of the image-bearing member and upstream to the cleaning blade in a rotating direction of the image-bearing member.

11. The apparatus according to claim 10, wherein proportion of rotation speed of the lubricant applying unit to the rotation speed of the image-bearing member when the rotation speed of the image-bearing member is the second speed is different from proportion of rotation speed of the lubricant applying unit to the rotation speed of the image-bearing member when the rotation speed of the image-bearing member is the first speed.

12. The apparatus according to claim 10, wherein the lubricant applying unit includes a solid lubricant and a rotating brush rotatably rubbing against the image-bearing member while being in contact with the solid lubricant, and wherein the controller changes, by changing rotation speed of the rotating brush, the rotation speed of the lubricant applying unit.

13. An image forming apparatus comprising:

a rotatable image-bearing member configured to bear a toner image;

a forming unit configured to form the toner image on the image-bearing member;

a cleaning blade configured to remove a residual toner from the image-bearing member by contacting to the image-bearing member;

a rotatable lubricant applying unit configured to apply a lubricant to the image-bearing member;

a first driving source;

a second driving source;

a first drive transmitting portion configured to transmit drive force supplied from the first driving source to the image-bearing member;

a second drive transmitting portion configured to transmit drive force supplied from the second driving source to the lubricant applying unit; and a controller configured to control the second driving source so that the rotation speed of the lubricant applying unit when rotation speed of the image-bearing member is in a first speed is less than the rotation speed of the lubricant applying unit when rotation speed of the image-bearing member is in a second speed that is faster than the first speed, wherein proportion of rotation speed of the lubricant applying unit to the rotation speed of the image-bearing member when the rotation speed of the image-bearing member is the second speed is different from proportion of rotation speed of the lubricant applying unit to the rotation speed of the image-bearing member when the rotation speed of the image-bearing member is the first speed.

14. The apparatus according to claim 13, wherein the lubricant applying unit includes a solid lubricant and a rotating brush rotatably rubbing against the image-bearing member while being in contact with the solid lubricant, and wherein the controller changes, by changing rotation speed of the rotating brush, the rotation speed of the lubricant applying unit.

* * * * *